US006749471B1

(12) United States Patent
Deverell

(10) Patent No.: US 6,749,471 B1
(45) Date of Patent: Jun. 15, 2004

(54) FLOTATION DEVICE FOR ALL-TERRAIN VEHICLE

(76) Inventor: Gregory D. Deverell, 134 Charleston-Gin Rd., Stanton, TN (US) 38069

( * ) Notice: Subject to any disclaimer, the term of this patent is extended or adjusted under 35 U.S.C. 154(b) by 0 days.

(21) Appl. No.: 10/420,667

(22) Filed: Apr. 22, 2003

(51) Int. Cl.[7] ..... B63H 21/175
(52) U.S. Cl. ..... 440/11; 114/123
(58) Field of Search ..... 114/123; 440/11, 440/12, 12.5–12.7

(56) References Cited

U.S. PATENT DOCUMENTS 3,011,184 A * 12/1961 Curcio ..... 441/40
3,211,124 A * 10/1965 Mantle ..... 440/11
3,908,577 A * 9/1975 Struyk ..... 440/11
4,494,937 A 1/1985 Riermann ..... 440/11
4,517,911 A * 5/1985 Seefeld ..... 114/267
4,664,051 A 5/1987 Newkirk ..... 114/123
4,712,636 A 12/1987 Ishimatsu ..... 180/198
4,716,850 A 1/1988 Lachance ..... 114/270
4,744,324 A 5/1988 Martinmaas ..... 114/270
5,690,046 A 11/1997 Grzech ..... 114/270
5,769,021 A 6/1998 Schad ..... 114/270

* cited by examiner

*Primary Examiner*—Ed Swinehart
(74) *Attorney, Agent, or Firm*—Walker, McKenzie & Walker, P.C.

(57) ABSTRACT

A floatation device for an all-terrain vehicle or the like. The floatation device includes a float having a bow float, and includes mounting structure for mounting the float to the frame of the vehicle. The bow float may be U-shaped, and the float may include a stern float, or tailgate, to extend across and close the open end of the U-shaped bow float so that vehicle is encircled by the float.

14 Claims, 3 Drawing Sheets

FLOTATION DEVICE FOR ALL-TERRAIN VEHICLE

BACKGROUND OF THE INVENTION

1. Field of the Invention

The present invention relates, in general, to floatation devices for attachment to motor vehicles such as four wheel all-terrain vehicles.

2. Information Disclosure Statement

Floatation devices for all-terrain vehicles have been developed prior to the present invention, but, perhaps due to the complexity of these prior floatation devices, have not been very marketable. One prevalent problem with known prior ail floatation devices for all-terrain vehicles is the abundance of hardware needed to attach them to the vehicles. Such prior art floatation devices appear to be time consuming and cumbersome for an individual to attach and remove. Today's four wheel all-terrain vehicles have a wide range of attachments available for many different uses that often require removal of one attachment to attach another.

A preliminary patentability search produced the following patents which appear to be relevant to the present invention:

Riermann, U.S. Pat. No. 4,494,937, issued Jan. 22, 1985, for a pontoon attachment for all terrain vehicle; and Newkirk, U.S. Pat. No. 4,664,051, issued May 12, 1987, for a three wheeler flotation conversion kit;

Lachance, U.S. Pat. No. 4,716,850, issued Jan. 5, 1988, for a floatation assembly for off-road vehicle;

Ishimatsu, U.S. Pat. No. 4,712,636, issued Dec. 15, 1987, for a carriage or watercraft;

Martinmaas, U.S. Pat. No. 4,744,324, issued May 17, 1988, for an amphibious all terrain vehicle and conversion kit;

Grzech, U.S. Pat. No. 5,690,046, issued Nov. 25, 1997, for amphibious vehicles; and Schad, U.S. Pat. No. 5,769,021, issued Jun. 23, 1998, for an amphibious craft.

None of known prior art references, either singly or in combination, disclose or suggest the present invention.

BRIEF SUMMARY OF THE INVENTION

The present invention is a floatation device that can be attached to a four wheel all-terrain vehicle or the like to make the vehicle amphibious.

It is an object of the present invention to provide a floatation device for a four wheel all-terrain vehicle, etc., that is easy to attach and remove and does not hinder the vehicle's normal operating ability.

Another object of the present invention is to provide a floatation device that is evenly displaced around the perimeter of a vehicle for a low center of gravity so as to maintain the vehicle's stability on land or water.

Another object of the present invention is to provide a floatation device that does not hinder the ground clearance of the vehicle.

Another object of the present invention is to provide a floatation device that will not hinder the vehicle's ability to enter or leave a body of water where shore line slopes are 1:1 or less.

Another object of the present invention is to provide a floatation device that substantially increases the load carrying ability of the vehicle (e.g., by an additional 250 pounds on the rear and/or 150 pounds on the front).

Another object of the present invention is to provide a two-piece buoyant member or pontoon of varying size that encompasses the perimeter of a four wheel all-terrain vehicle.

Another object of the present invention is to provide a floatation device that attaches to the rear hitch of an all-terrain vehicle with a pin connection and to the front frame of the all-terrain vehicle.

Another object of the present invention is to provide a floatation device that is adjustable at the front and rear of the vehicle to suit the operator's needs.

Another object of the present invention is to provide a floatation device that has a 45° upward pitch at the front off the front center of the front tires as to allow the vehicle to leave the water easily and to also create lift in water while in forward motion.

Another object of the present invention is to provide a floatation device that has indentations or steps for allowing easy mounting and dismounting of the vehicle.

Figure 1:
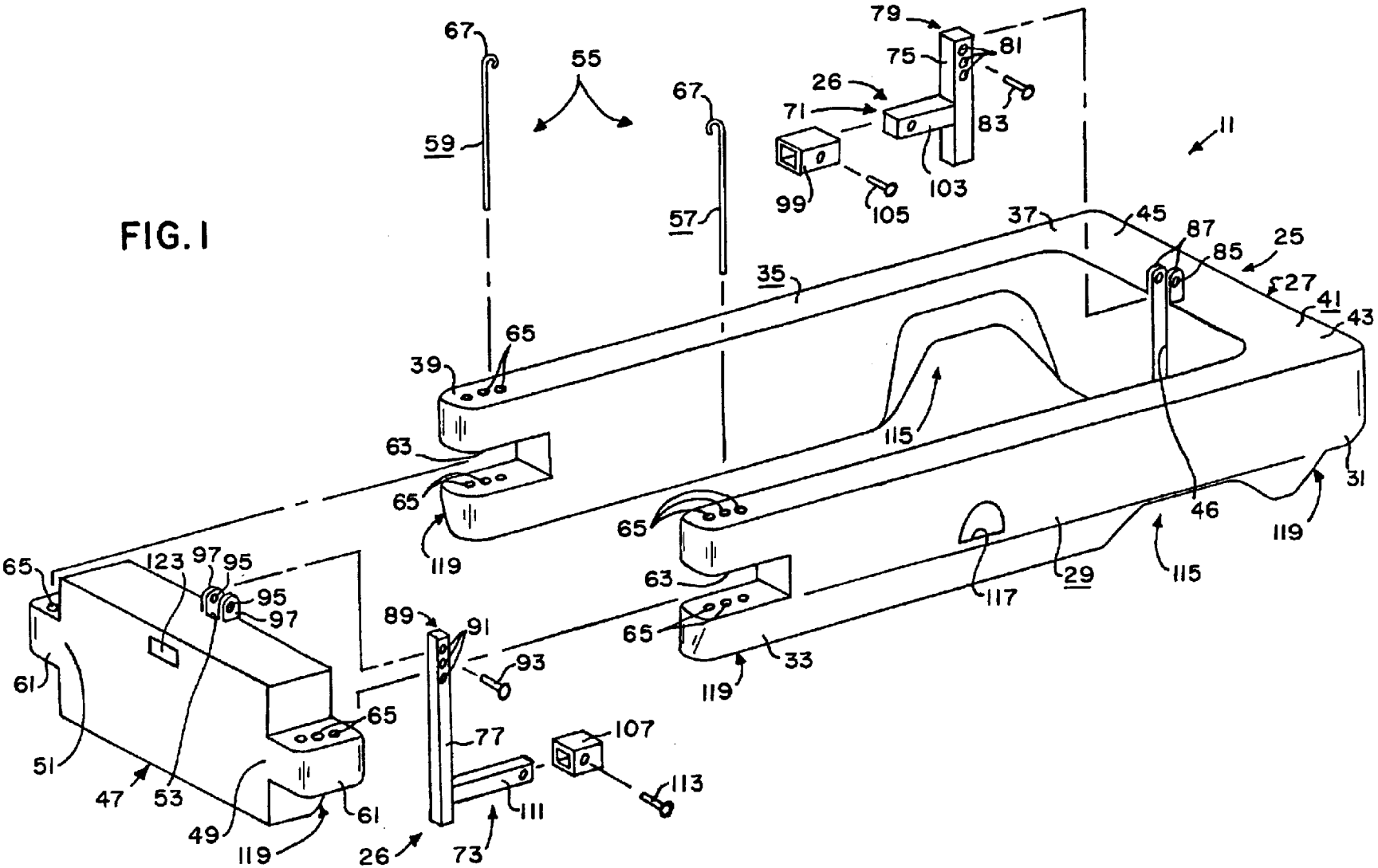
FIG. 1 is an exploded perspective view of the floatation device of the present invention.
Figure 2:
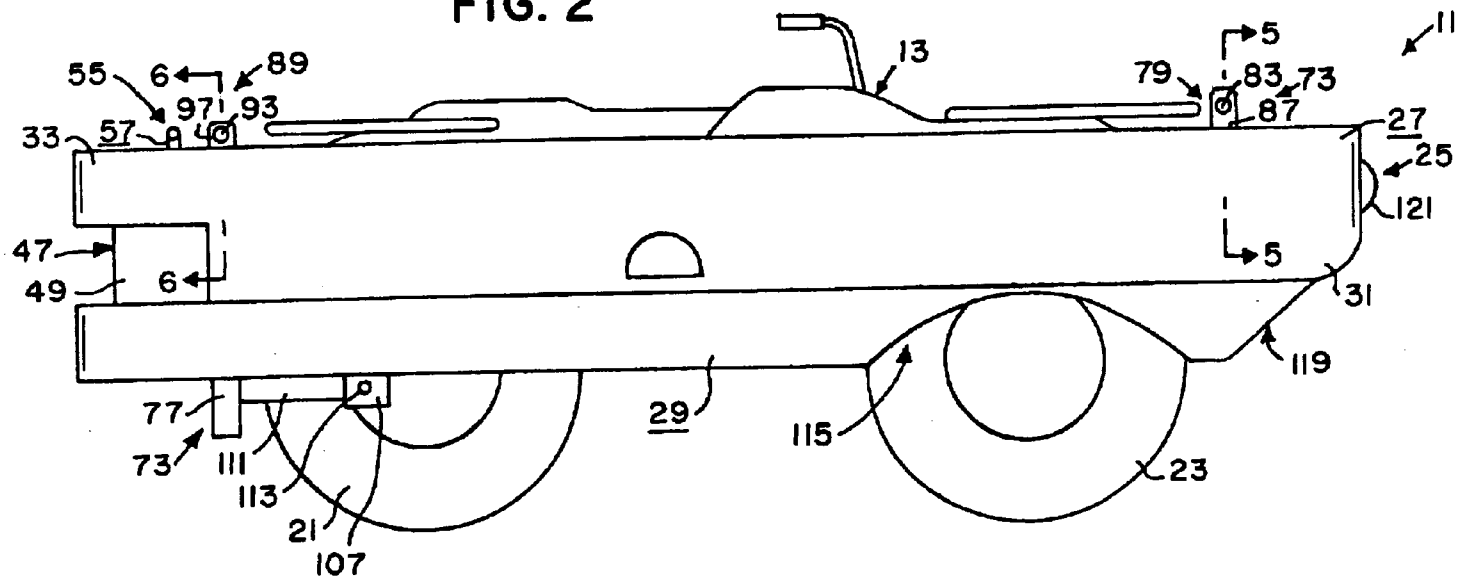
FIG. 2 is a side elevational view of the floatation device of the present invention shown attached to an all-terrain vehicle.
Figure 3:
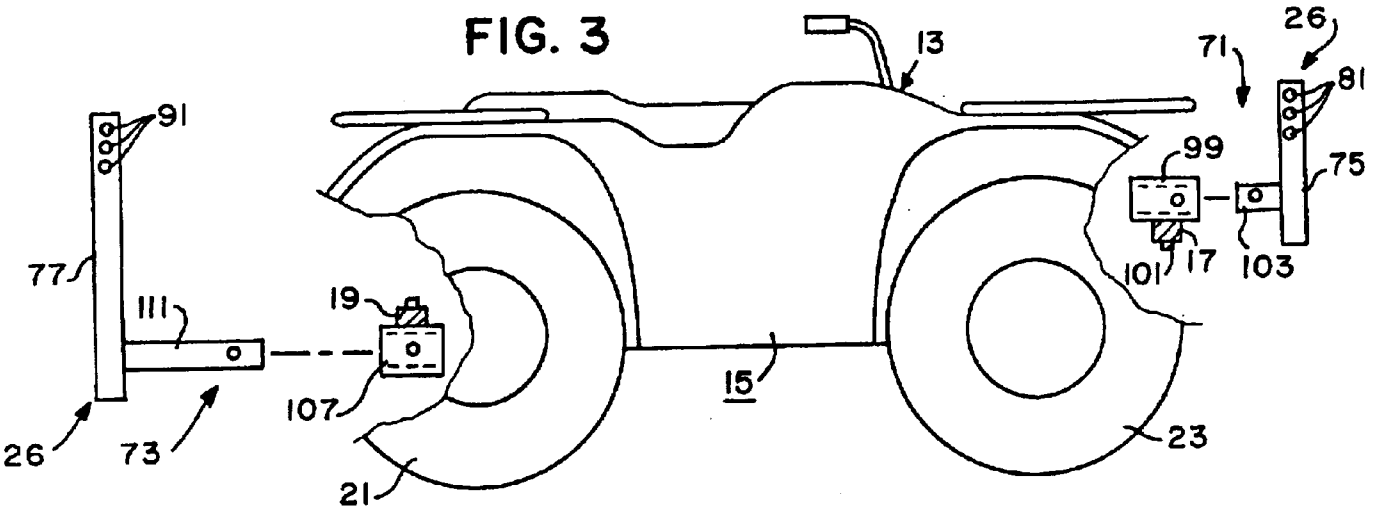
FIG. 3 is a side elevational view of an all-terrain vehicle with portions thereof broken away for clarity and showing vertically arranged posts of mounting means of the floatation device of the present invention in position for attachment to the frame of the vehicle.
Figure 4:
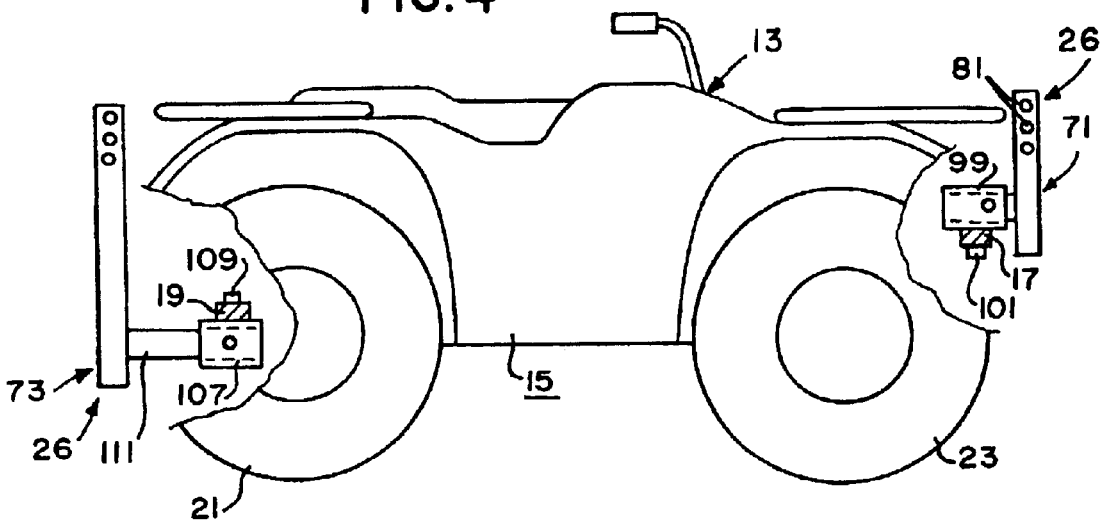
FIG. 4 is a side elevational view similar to FIG. 3 but showing the vertically arranged posts of the mounting means of the floatation device attached to the frame of the vehicle.
Figure 5:
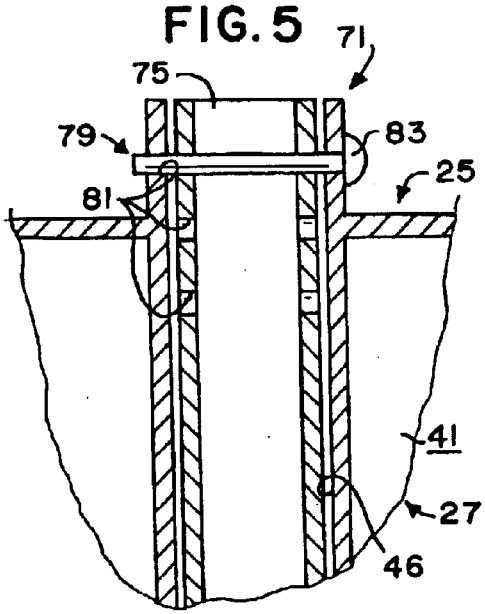
FIG. 5 is a sectional view substantially as taken on line 5—5 of FIG. 2, on an enlarged scale and with portions thereof broken away for clarity.
Figure 6:
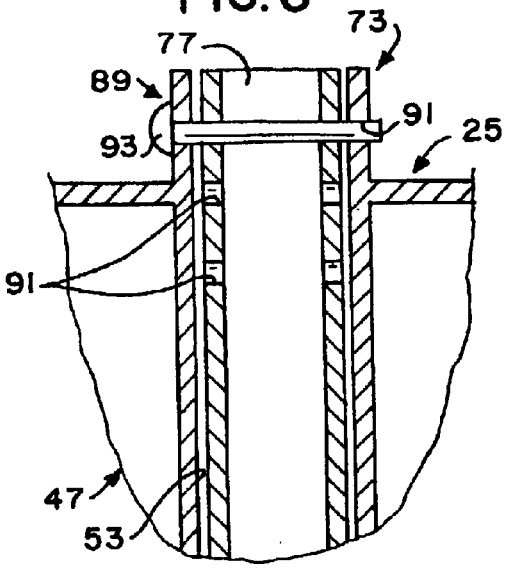
FIG. 6 is a sectional view substantially as taken on line 6—6 of FIG. 2, on an enlarged scale and with portions thereof broken away for clarity.

DETAILED DESCRIPTION OF THE INVENTION preferred embodiment of the floatation device of the present invention is shown in FIGS. 1-6 and identified by the numeral 11. The floatation device 11 is especially designed for a vehicle 13 such as, e.g., a typical motorized four wheel all-terrain vehicle, having a frame 15 with a front 17 and a rear 19, a rear wheel assembly 21, and a front wheel assembly 23.

The floatation device 11 includes a float 25, and mounting means 26 for mounting, or fixing, the float 25 to the frame 15 of the vehicle 13 to thereby make the vehicle 13 amphibious without hindering the maneuverability and stability of the vehicle 13 on land.

The float 25 includes a bow float 27 for extending around the front of the vehicle 13. The bow float 27 is preferably U-shaped in plan, having a first side member 29 with a first end 31 and a second end 33, a second side member 35 with a first end 37 and a second end 39, and a front member 41 with a first end 43 attached to the first end 31 of the first side member 29 and a second end 45 attached to the first end 37 of the second side member 35. The front member 41 of the bow float 27 may have a preferably vertically arranged slot 46 therein (see, in general, FIGS. 1 and 5) for use in attaching the bow float 27 to the vehicle 13 as will hereinafter become apparent.

The float 25 preferably includes a stern float 47 extending between the second ends 33, 39 of the first and second side members 29, 35 of the bow float 27. The stern float 47 is preferably a movable gate-like transverse member for selectively closing the opened end of the U-shaped bow float 27 so that the float 25 will completely encircle the periphery of the vehicle 13. The stern float 47 preferably has a first end 49 for being fastened to the second end 33 of the first side member 29 of the bow float 27, and a second end 51 for being fastened to the second end 39 of the second side member 35 of the bow float 27. The stern float 47 may have a preferably vertically arranged slot 53 therein (see, in general, FIGS. 1 and 6) for use in attaching the stern float 47 to the vehicle 13 as will hereinafter become apparent.

The floatation device 11 preferably includes fastening means 55 for fastening the bow float 27 and stern float 47 together. The fastening means 55 may include a first pin member 57 for extending through the second end 33 of the first side member 29 of the bow float 27 and the first end 49 of the stem float 47, and a second pin member 59 for extending through the second end 39 of the second side member 35 of the bow float 27 and the second end 51 of the stern float 47. The fastening means 55 is preferably designed to allow horizontal adjustment of the stern float 47 on the second ends 33, 39 of the first and second side members 29, 35 of the bow float 27. For example, each end 49, 51 of the stern float 47 may have a boss or tab-like projection 61, a slot 63 may be formed in the second ends 33, 39 of the side members 29, 35 for receiving a respective projection 61, and a plurality of vertically extending, longitudinally spaced apertures 65 may be formed through the projections 61 and the portions of the second ends 33, 39 of the side members 29, 35 adjoining the slots 63. This allows the bow and stern floats 27, 47 to be easily fastened together by merely passing the first pin member 57 through apertures 65 in the second end 33 of the first side member 29 of the bow float 27 and in the projection 61 on the first end 49 of the stern float 47, and passing the second pin member 59 through apertures 65 in the second end 39 of the second side member 35 of the bow float 27 and in the projection 61 on the second end 51 of the stern float 47, and allows horizontal adjustment of the stern float 47 relative to the bow float 27 by merely passing the pin members 57, 59 through different sets of apertures 65, etc., to allow the float 25 to be adjusted to optimally fit vehicles 13 of varying lengths. As shown in the drawings, there may be three spaced apart sets of apertures 65 to allow at least three positions for the stern float 47 on the bow float 27 to optimally fit vehicles 13 of at least three different lengths. Each pin member 57, 59 may have a hook or ring-shaped upper end 67 and coacting hooks or the like (not shown) may be mounted on each side member 29, 35 of the bow float 27 adjacent the apertures 65 therethrough for allow firm attachment of the pin members 57, 59 to the bow float 27.

The mounting means 26 preferably includes a front mounting assembly 71 for attaching the bow float 27 to the front 17 of the frame 15 of the vehicle 13, and a rear mounting assembly 73 for attaching the stern float 47 to the rear 19 of the frame 15 of the vehicle 13.

The front mounting assembly 71 may include a preferably vertically arranged post 75 for attachment to the front 17 of the frame 15 of the vehicle 13. The rear mounting assembly 73 may also include a preferably vertically arranged post 77 for attachment to the rear 19 of the frame 15 of the vehicle 13. The front mounting assembly 71 preferably includes attachment means 79 for allowing vertical adjustment of the bow float 27 on the post 75 so that the vertical positioning of the front of the bow float 27 relative to the vehicle 13 can be adjusted. Thus, for example, the upper end of the post 75 may have a plurality of vertically spaced apertures 81 therethrough and the attachment means 79 may include a pin member 83 for extending through one of the apertures 81 in the post 75 and through apertures 85 in ear members 87 on the bow float 27 at the upper end of the slot 46 to thereby allow vertically adjustable attachment of the bow float 27 on the post 75 as will now be apparent to those skilled in the art.

Likewise, the rear mounting assembly 73 preferably includes attachment means 89 for allowing vertical adjustment of the stern float 47 on the post 77 so that the vertical positioning of the stern float 47 relative to the vehicle 13 can be adjusted. Thus, for example, the upper end of the post 77 may have a plurality of vertically spaced apertures 91 therethrough and the attachment means 89 may include a pin member 93 for extending through one of the apertures 91 in the post 77 and through apertures 95 in ear members 97 on the stern float 47 at the upper end of the slot 53 to thereby allow vertically adjustable attachment of the stern float 47 on the post 77 as will now be apparent to those skilled in the art.

The post 75 may be attached to the frame 15 of the vehicle 13 in a manner which allows easily removal thereof. Thus, for example, a receiver sleeve 99 is preferably attached to the front 17 of the frame 15 of the vehicle 13 by bolts 101 or the like, the post 75 preferably having a boss-like projection 103 extending outward therefrom for being inserted into the receiver sleeve 99, and a pin 105 is provided for extending through apertures in both the receiver sleeve 99 and projection 103 to secure the post 75 to the frame 15 in a manner which allows it to be easily removed therefrom when desired as will now be apparent to those skilled in the art.

Likewise, the post 77 may be attached to the frame 15 of the vehicle 13 in a manner which allows easily removal thereof. Thus, for example, a receiver sleeve 107 is preferably attached to the rear 19 of the frame 15 of the vehicle 13 by bolts 109 or the like, the post 77 preferably has a boss-like projection 111 extending outward therefrom for being inserted into the receiver sleeve 107, and a pin 113 is provided for extending through apertures in both the receiver sleeve 107 and projection 111 to secure the post 77 to the frame 15 in a manner which allows it to be easily removed therefrom when desired as will now be apparent to those skilled in the art.

The bow and stem floats 27, 47 can be constructed in various designs and sizes, and out of various materials as will now be apparent to those skilled in the art. Thus, for example, each float 27, 47 may be molded out of fiberglass or aluminum to from a strong, buoyant body. Recesses 115 are preferably provided in the first and second side members 31, 35 adjacent the front or first ends 31, 37 thereof for accommodating the front wheel assembly 23 of the vehicle 13 such as, for example, when the front wheel assembly 23 of the vehicle 13 is being turned. Steps 117 may be formed in the first and second side members 31, 35 for aiding the driver or rider of the vehicle 13 to mount and dismount the vehicle 13. The leading bottom edges of the bow float 27 and stern float 47, and the outer side bottom edges of the bow float 27 may be sloped as indicated by the numeral 119 to provide lift when the vehicle is in the amphibious mode, and provide clearance during navigation, etc., as will now be apparent to those skilled in the art. Headlight means 121 may be provided on the front face of the bow float 27, and taillight/brake light means 123 may be provided on the rear face of the stern float 47 for visibility and safety concerns.

To use the floatation device 11, the receiver sleeves 99, 107 are attached to the respective front and rear 17, 19 of the frame 15 via bolts 101, 109, etc. It should be noted that at least the rear receiver sleeve 107 may consist of the rear trailer hitch receiver sleeve of the vehicle 13 and thus may be pre-attached to the vehicle 13 as will now be apparent to those skilled in the art. The posts 75, 77 can the be attached to the respective receiver sleeves 99, 107 via pins 105, 113. Next, the float 25 can be supported on the ground, etc., and the stern float 47 removed from the bow float 27 via the pins 57, 59, to allow the vehicle 13 to be merely driven into the U-shaped portion of the bow float 27 until at least portions of the post 75 extend into the slot 46. The stern float 47 can then be placed on the bow float 27, moved forwardly until the post 77 extends into the slot 53, and then attached to the bow float 27 via the pins 57, 59. The float 25 can then be raised vertically to the desired level relative to the vehicle 13 and attached to the vehicle 13 by way of the pins 83, 93 as will now be apparent to those skilled in the art. The float 25 can easily and quickly be removed from the vehicle 13 by reversing those steps.

Although the present invention has been described and illustrated with respect to a preferred embodiment and a preferred use therefor, it is not to be so limited since modifications and changes can be made therein which are within the full intended scope of the invention.

What is claimed is:

1. A floatation device for a vehicle of the type having a frame with a front and a rear, a rear wheel assembly, and a front wheel assembly; said floatation device comprising:

a) a float, said float including a bow float having a first side member with first and second ends, a second side member with first and second ends, and a front member with a first end attached to said first end of said first side member and a second end attached to said first end of said second side member; and b) mounting means for mounting said float to the frame of the vehicle; said mounting means including a front mounting assembly for mounting said bow float to the front of the frame of the vehicle; said front mounting assembly including a post for attachment to the front of the frame of the vehicle;

said front member of said bow float having a slot for receiving said post of said front mounting assembly.

2. The floatation device of claim 1 in which said post of said front mounting assembly and said slot of said front member of said bow float are arranged vertically.

3. The floatation device of claim 1 in which said front mounting assembly includes attachment means for adjustably attaching said post thereof to said front member of said bow float.

4. The floatation device of claim 3 in which said attachment means of said front mounting assembly allows vertical adjustment of said front member of said bow float on said post of said front mounting means.

5. The floatation device of claim 1 in which said float includes a stern float extending between said second ends of said first and second side members of said bow float.

6. The floatation device of claim 5 in which is included fastening means for fastening said stern float to said second ends of said first and second side members of said bow float.

7. The floatation device of claim 1 in which said first and second side members of said bow float have recesses therein for the front wheel assembly of the vehicle.

8. The floatation device of claim 1 in which said first and second side members of said bow float have steps.

9. A floatation device for a vehicle of the type having a frame with a front and a rear, a rear wheel assembly, and a front wheel assembly; said floatation device comprising:

a) a float, said float including a bow float having a first side member with first and second ends, a second side member with first and second ends, and a front member with a first end attached to said first end of said first side member and a second end attached to said first end of said second side member; said float including a stern float extending between said second ends of said first and second side members of said bow float; and b) mounting means for mounting said float to the frame of the vehicle; said mounting means including a rear mounting assembly for mounting said stem float to the rear of the frame of the vehicle; said rear mounting assembly including a post for attachment to the rear of the frame of the vehicle;

said stern float having a slot for receiving said post of said rear mounting assembly.

10. The floatation device of claim 9 in which said post of said rear mounting assembly and said slot of said stern float are arranged vertically.

11. The floatation device of claim 10 in which said rear mounting assembly includes attachment means for adjustably attaching said post thereof to said stern float.

12. The floatation device of claim 11 in which said attachment means of said rear mounting assembly allows vertical adjustment of said stern float on said post of said rear mounting means.

13. A floatation device for a vehicle of the type having a frame with a front and a rear, a rear wheel assembly, and a front wheel assembly; said floatation device comprising:

a) a float, said float including a bow float having a first side member with first and second ends, a second side member with first and second ends, and a front member with a first end attached to said first end of said first side member and a second end attached to said first end of said second side member; said float including a stern float extending between said second ends of said first and second side members of said bow float b) mounting means for mounting said float to the frame of the vehicle; and c) fastening means for fastening said stern float to said second ends of said first and second side members of said bow float; said fastening means allowing horizontal adjustment of said stern float on said second ends of said first and second side members of said bow float.

14. The floatation device of claim 13 in which said stern float has a first end and a second end; and in which said fastening means includes a first pin member for extending through said second end of said first side member of said bow float and said first end of said stern float, and a second pin member for extending through said second end of said second side member of said bow float and said second end of said stern float.

* * * * *